US006128784A

United States Patent [19]

Frank

[11] Patent Number: 6,128,784

[45] Date of Patent: Oct. 10, 2000

[54] SELF-VENTILATING COOLING VEST

[76] Inventor: Ronald H. Frank, 2725 Flynn Cove Rd., Jacksonville, Fla. 32223

[21] Appl. No.: 09/453,238

[22] Filed: Dec. 2, 1999

[51] Int. Cl.[7] ..... A41D 1/04

[52] U.S. Cl. ..... 2/102; 2/DIG. 1; 2/DIG. 3

[58] Field of Search ..... 2/102, 69, 79, 2/2.11, DIG. 1, DIG. 3; 251/5, 205; 137/846; 417/566, 567

[56] References Cited

U.S. PATENT DOCUMENTS

| | | | |
|---|---|---|---|
| 1,623,993 | 4/1927 | Anderson | 2/102 |
| 2,648,325 | 8/1953 | Siple . | |
| 3,348,236 | 10/1967 | Copeland . | |
| 3,995,329 | 12/1976 | Zafuto | 2/DIG. 3 |
| 4,185,327 | 1/1980 | Markve | 2/DIG. 1 |
| 4,194,247 | 3/1980 | Melander | 2/DIG. 1 |
| 4,451,934 | 6/1984 | Gioello | 2/DIG. 1 |
| 5,005,216 | 4/1991 | Blackburn et al. . | |
| 5,010,925 | 4/1991 | Atkinson et al. | 137/847 |
| 5,050,240 | 9/1991 | Sayre . | |
| 5,255,390 | 10/1993 | Gross et al. . | |

FOREIGN PATENT DOCUMENTS

| | | | |
|---|---|---|---|
| 2108822 | 5/1983 | United Kingdom | 2/DIG. 1 |

*Primary Examiner*—John J. Calvert
*Assistant Examiner*—Tejash Patel
*Attorney, Agent, or Firm*—Thomas C. Saitta

[57] ABSTRACT

A self-ventilating vest having a plural number of conduits extending through the vest, the conduits having an intake opening and one-way intake valve through which outside air can be drawn into the conduit, one or more compressible members, such as a tube, bulb or bladder retaining the air so that it absorbs body heat, and a one-way exhaust valve and exhaust opening through which the warmed air is expelled. The compressible members are compressed by the expansion of the chest during breathing or exertion to expel the warmed air, and when the compressive forces are removed, the compressible members expand to draw fresh air back into the compressible members through the intake opening to repeat the cycle.

12 Claims, 3 Drawing Sheets

SELF-VENTILATING COOLING VEST

BACKGROUND OF THE INVENTION

This invention relates generally to the field of vests or other body-worn devices or articles of clothing which contain means to cool the wearer by removing body heat and exhausting it to the ambient air. In particular, the invention relates to such vests and devices where the body heat is removed by passing air through tubes mounted on or within the vest or device, the air absorbing the body heat prior to it being exhausted.

Many occupations require the wearing of heavy, stiff, thick or padded articles of clothing, and in particular vests which have these properties. For examples, many workers must wear vests or body suits containing multiple pockets or retainers for equipment, or workers such as policemen wear protective bullet-proof vests. While of obvious benefit to the wearer, these vests can be uncomfortable in hot weather or when the wearer performs exerting tasks, as they tend to trap the body heat produced by the wearer. In southern climates, this uncomfortable heat-trapping side effect sometimes results in a personal decision not to wear the vest, which is not desirable.

Attempts have been made to solve the heat-trapping problem by providing internal circulation systems within the vest or article of clothing. Such devices are shown for example in U.S. Pat. No. 5,255,390 to Gross et al., U.S. Pat. No. 5,050,240 to Sayre U.S. Pat. No. 5,005,216 to Blackburn et al., and U.S. Pat. No. 3,348,236 to Copeland. These devices utilize an outside source of pressurized air or fluid to pass cool air or fluid into the internal conduits, which is then exhausted or recirculated after absorbing body heat from the wearer. Siple, in U.S. Pat. No. 2,648,325, while directed at producing a body warming vest, is relevant in that it discloses a closed circulating system with no outside fluid source, where the temperature of the fluid is raised by chemical means and the circulation occurs as a function of the breathing or movement of the wearer, the expansion and contraction of the chest pressing against bulbs which force fluid flow in a single direction because of the presence of a single one-way valve in each conduit. This construction would not work for cooling the wearer, since there is not provided any means to exhaust and replace, or to cool the fluid, once it has absorbed body heat from the wearer.

It is an object of this invention to provide an article of clothing, and in particular a vest, which cools the wearer by removing body heat, where the heat is absorbed by relatively cooler air drawn from the outside ambient air which is passed through conduits in the article of clothing and exhausted, such that the system does not recirculate the air. It is a further object to provide such a device where the air is drawn into and expelled from the device with no outside pressurization means or forced air pumping apparatus, such that the device is self-ventilating. It is a further object to provide such a device where the expansion and contraction of the chest of the wearer, or physical body movement, is sufficient to cause air warmed by body heat to be exhausted from the device into the outside atmosphere and is sufficient to cause relatively cooler air to be drawn into the device from the outside atmosphere. It is a further object to provide such a device which contains multiple pairs of one-way check valves mounted in individual conduits, where the valve pairs are oriented such that flow through the conduit occurs in a single direction only, where the conduits may comprise tubes, bladders, bulbs or combinations thereof to provide the self-ventilation means to pass air through the device. These and other objects not expressly stated will be accomplished as set forth in the disclosure below.

SUMMARY OF THE INVENTION

The invention is a device which may comprise an article of clothing, and in particular an article of clothing worn on the chest, such as a shirt, vest or the upper portion of a body suit, which cools the wearer by providing a means for relatively cool outside air to be drawn into the device and then exhausted. The cool air absorbs body heat from the wearer, such that the temperature of the air within the vest is elevated. This warmer air is then expelled or exhausted from the vest, with fresh cooler air drawn in to repeat the cycle continuously. The device is provided with air conduits, either positioned within the device or mounted on its interior side, which comprise tubes, bladders, bulbs or combinations thereof, where some of the components are compressible by the expansion of the chest of the wearer or from body movement, such that air within the compressible components is forced from the components and expelled from the conduits. The compressible components are constructed of material having a resilient memory, typically a plastic or rubber, and are designed with a wall structure and thickness such that when pressure is removed from the components the components expand back to their non-compressed configuration, thereby drawing air into the components and the conduits. Each of the conduits is arranged to communicate with an intake opening and an exhaust opening. A one-way check valve, such as a plastic duck-billed slit valve or the like, is positioned adjacent the intake opening and oriented such that air flow can only occur into the conduit through the intake opening. Likewise, a one-way check valve is positioned adjacent the exhaust opening and oriented in the same direction as the other valve, so that air flow can only occur from the conduit through the exhaust outlet. The intake and exhaust openings communicate with the outside ambient air, and multiple conduits may be connected to a manifold with an extension tube of sufficient length to be positioned external to any articles of clothing surrounding the self-ventilating device. In this manner, pressure against the compressible components forces warmed air within the conduits out the exhaust openings, while the expansion of the compressible components when the pressure is removed causes cooler air to be drawn back into the conduits. This cycle is repeated with every expansion/contraction cycle of the chest, such that the device is self-ventilating with no need for a powered means to force the air through the device.

DETAILED DESCRIPTION OF THE INVENTION

With reference to the drawings, the invention will now be described in detail with regard to the best mode and the preferred embodiment. The invention comprises a self-ventilating article of clothing or a device to be worn on the body, preferably in the form of a vest, which acts to cool the wearer by drawing relatively cool outside air from the atmosphere into the device, where the air absorbs body heat produced by the wearer and is exhausted back into the atmosphere, with the cycle repeating. The operational force for the device is the movement of the wearer's body, and in particular the expansion and contraction of the wearer's chest from breathing or exertion, with no requirement for a powered or pressurized means to force air through the device. For simplicity, the invention will be described in the preferred embodiment of the vest configuration, but it is to be understood that the invention can comprise other articles of clothing, including shirts, coats, jackets, body suits, etc., and may also comprise articles of clothing such as pants or shorts where the operational force for the device is the movement of the legs during walking or running. The invention may be provided as a cooling vest which is worn underneath and in addition to other articles of clothing or bulky devices, such as a coat, shirt, vest (and in particular, bullet-proof vests), etc., or the invention may comprise the actual coat, shirt, vest, device, etc., where the operational components are built directly into or attached to the article of clothing or device in an integral manner. The invention works with optimum efficiency when it is positioned directly against the skin of the user or when separated from the user's skin only by thin material which allows relatively unimpeded passage of body heat.

Figure 1:
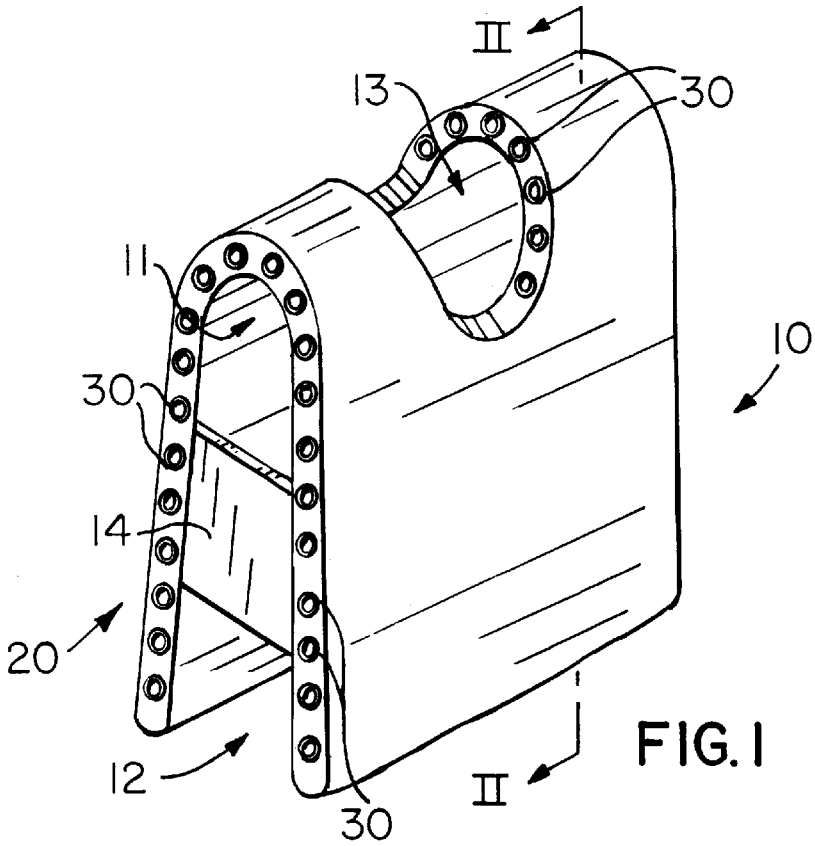
FIG. 1 is a perspective view showing the invention embodied as a vest.
Figure 2:
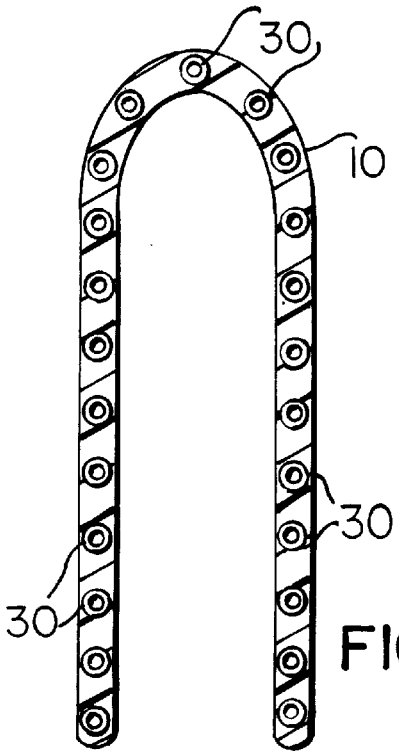
FIG. 2 is a cross-sectional view taken along line II—II of FIG. 1.
Figure 3:
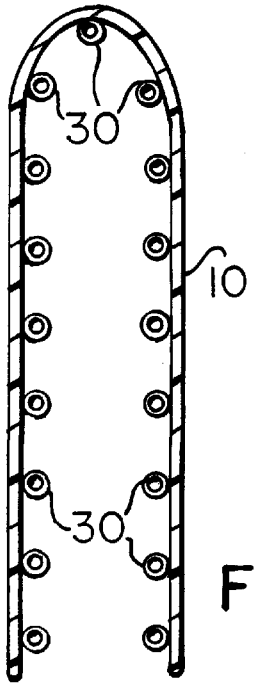
FIG. 3 is a cross-sectional view similar to FIG. 2 of an alternative embodiment of the invention.

As shown in FIG. 1, the invention comprises a plural number of self-ventilating conduit means 20 affixed to some manner of webbing or other material such that the relative positions of the conduit means 20 are maintained when the device is worn on the body. As illustrated, the conduit means 20 are positioned within a vest 10 having two arm openings 11, a torso opening 12 and a head opening 13. Side panels or straps 14 may be provided to further structure the vest 10. The vest 10 can be made of any suitable material, including cloth, plastics, plastic foams, etc., so long as any material which covers the conduit means 20 or resides between the conduit means 20 and the wearer is permeable to heat. The conduit means 20 may be incorporated within the body of the vest 10, as shown in FIG. 2, or may be mounted on the interior side of the vest 10, as shown in FIG. 3.

The self-ventilating conduit means 20 comprise a relatively large number of ventilating means defined as compressible members 30, the compressible members 30 defining hollow bodies where the wall structure of the compressible members 30 is such that they may be relatively easily compressed, such as by the expansion of the wearer's chest during breathing. The compressible members 30 are retained such that the interior walls 35 of the compressible members 30 are deflected inward relative to the exterior walls 36 of the compressible members 30. In addition, the material of construction, the interior wall 35 thickness and the overall shape of the compressible members 30 are chosen such that the compressible members 30 rebound to the neutral position when all compressive forces are removed, such that the interior space of the compressible members 30 is maximized. Preferably the compressible members 30 are composed of a plastic or rubber material.

Figure 4:
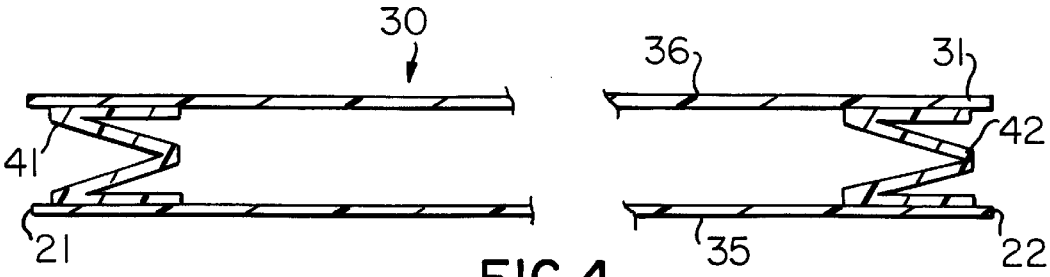
FIG. 4 is a cross-sectional view of a compressible member comprising a tube, shown in the neutral position.
Figure 5:
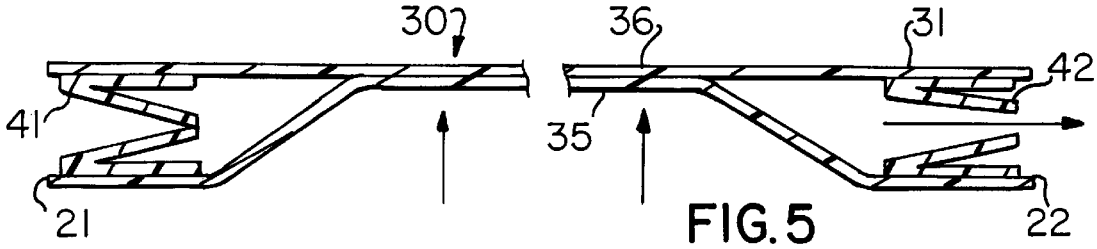
FIG. 5 is a cross-sectional view of the member of FIG. 4, shown in the compressed position such that air is expelled through the exhaust valve and opening.
Figure 6:
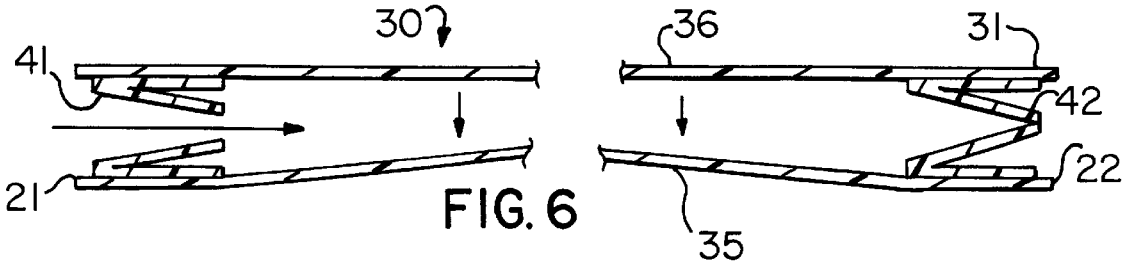
FIG. 6 is a cross-sectional view of the member of FIG. 4, shown in the expanding position such that air is drawn in through the inlet opening and valve.

In one embodiment, the compressible members 30 are compressible tubes 31 which extend through the body of the vest 10. The tubes 31 may extend horizontally as shown, vertically or any desired direction. They may be relatively straight as shown, or configured in more intricate patterns. Adjacent each end of each tube 31 is an intake valve 41 and an exhaust valve 42, which comprise one-way valves which are self-closing and opened by air pressure, such as a duck-billed or slit valve of the type well known in the art. As shown in FIGS. 4, 5 and 6, the intake valve 41 and the exhaust valve 42 are positioned such that air flow through the conduit means 20 and compressible member 30 is possible in only one direction. The end of the tube 31 adjacent or near the intake valve 41 is the intake opening 21 to receive relatively cool air from the atmosphere, while the end of the tube 31 adjacent or near the exhaust valve 42 is the exhaust opening 22 through which air warmed by body heat is exhausted. The tubes 31 may extend some distance beyond the vest 10 in order to communicate with the atmosphere when the vest 10 is covered by other clothing.

The operation of the self-ventilating conduit means 20 begins with the compressible members 30 in the passive or neutral position, as shown by compressible tube 31 in FIG. 4. The interior within the tube 31 is maximized such that a good volume of air resides within the tube 31. This air absorbs body heat from the wearer, such that the air is warmed and the body is cooled. When the wearer expands the chest or performs certain physical movements, the interior wall 35 of the tube 31 is compressed outward against the exterior wall 36, as shown in FIG. 5. This forces the warmed air out through exhaust valve 42 and exhaust opening 22 into the atmosphere, with intake valve 41 remaining closed. When the compressive forces are removed, as shown in FIG. 6, the resilient nature of the interior wall 35 causes it to expand inward to ward the wearer's body, which draws cooler air from the atmosphere through the intake opening 21 and intake valve 41, filling the compressible tube 31 with new air to absorb body heat. The exhaust valve 42 remains closed during this intake process. With every chest expansion or movement, the cycle repeats, with warmed being exhausted to atmosphere and cooler being drawn in to replace it.

Figure 7:
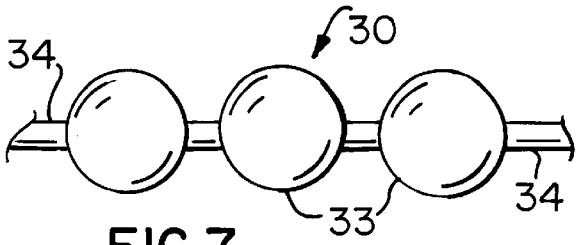
FIG. 7 is an alternative embodiment for the compressible member, where bulb members are employed.
Figure 8:
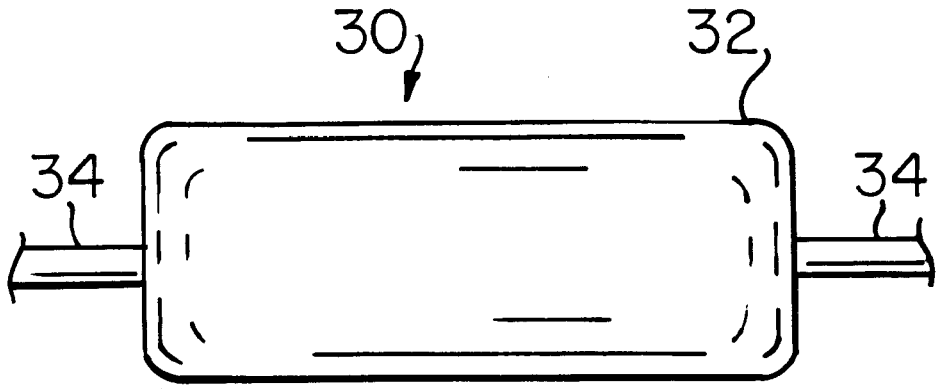
FIG. 8 is another alternative embodiment for the compressible member, where a large bladder member is employed.

Alternative configurations for the compressible members 34 are shown in FIG. 7, where the compressible members 30 comprise rounded bulbs 33 connected in series by connecting tubes 34, and in FIG. 8, where the compressible members 30 comprise relatively large bladders 32 joined by connecting tubes 34. The self-ventilating operation of the bulbs 33 and bladders 32 is the same as described above for the compressible tubes 31.

Figure 9:
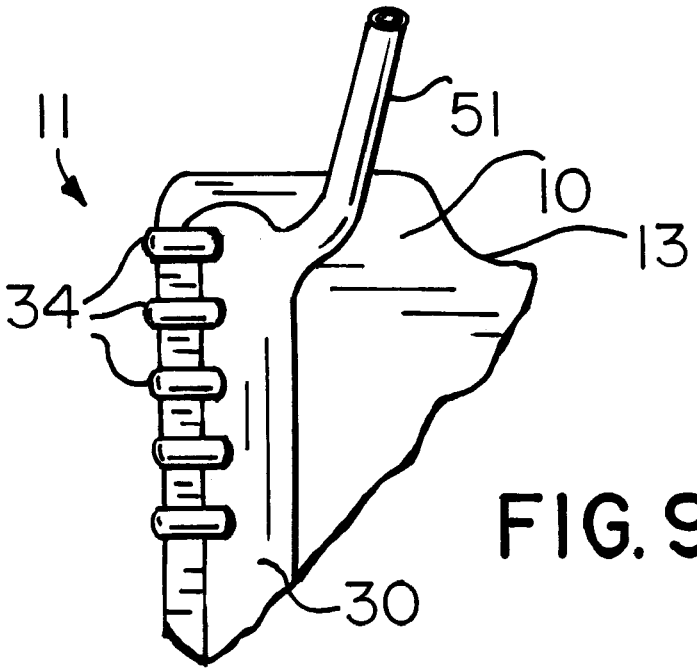
FIG. 9 shows an alternative embodiment of the invention, where the individual conduits are connected to a manifold.

Depending on the particular construction chosen for the invention, and depending on the types of clothing or devices which may be worn external to the invention, it may be necessary to provide extension means for the intake openings 21 and exhaust openings 22 to reach and communicate with the outside air. In a simple form, the conduit means 20 may simply extend some distance beyond the vest or other article of clothing. Alternatively, multiple conduit means 20 may be connected to common manifold bodies 50, as shown in FIG. 9, where each manifold 50 has an extension tube 51 which may be positioned with its opening communicating with the atmosphere. In this configuration the intake air will be drawn through a manifold 50 communicating with the intake valves 41 of the conduit means 20 and the exhaust air will be expelled through a second manifold 50 communicating with the exhaust valves 42 of the conduit means 20.

It is contemplated that equivalents and substitutions to certain elements set forth above may be obvious to those skilled in the art, and therefore the true scope and definition of the invention is to be as set forth in the following claims.

I claim:

1. A self-ventilating, body cooling device worn on the body which draws air from the atmosphere through the device, where said air is warmed by body heat and then expelled from said device, said device comprising conduit means each comprising an intake opening open to the atmosphere, at least one compressible member which is compressible by body movement, an exhaust opening, a one-way intake valve communicating with the atmosphere which allows air from the atmosphere to be drawn in through said intake opening and into said at least one compressible member, and a one-way exhaust valve which allows said air to be expelled from said at least one compressible member and out through said exhaust opening into the atmosphere, where said air is expelled through said exhaust valve when said at least one compressible member is compressed by body movement and where said at least one compressible member expands to draw new air into said at least one compressible member through said intake valve when said compressible member is not compressed by body movement.

2. The device of claim 1, where said at least one compressible member comprises a tube.

3. The device of claim 1, where said at least one compressible member comprises a bulb.

4. The device of claim 1, where said at least one compressible member comprises a bladder.

5. The device of claim 1, where said conduit means are joined to a manifold body which communicates with the atmosphere.

6. The device of claim 1, where said conduit means are mounted within a vest.

7. The device of claim 1, where said conduit means are mounted on the interior of a vest.

8. A self-ventilating, body cooling vest worn on the body which draws air from the atmosphere through the vest, where said air is warmed by body heat and then expelled from said vest, said vest comprising conduit means each comprising an intake opening communicating with the atmosphere, at least one compressible member for drawing air into and expelling air from said vest which is compressible by body movement, an exhaust opening, a one-way intake valve which allows air to be drawn in through said intake opening from outside of said vest and into said at least one compressible member, and a one-way exhaust valve which allows said air to be expelled from said at least one compressible member and out through said exhaust opening into the atmosphere, where said air is expelled through said exhaust valve when said at least one compressible member is compressed by body movement and where said at least one compressible member expands to draw new air into said at least one compressible member through said intake valve when said compressible member is not compressed by body movement.

9. The device of claim 8, where said at least one compressible member comprises a tube.

10. The device of claim 8, where said at least one compressible member comprises a bulb.

11. The device of claim 8, where said at least one compressible member comprises a bladder.

12. The device of claim 8, where said conduit means are joined to a manifold body which communicates with the atmosphere.

* * * * *